US007909535B2

(12) United States Patent
Samara

(10) Patent No.: US 7,909,535 B2
(45) Date of Patent: Mar. 22, 2011

(54) SOIL DRAINAGE SYSTEM

(76) Inventor: Emile A. Samara, Springfield, IL (US)

( * ) Notice: Subject to any disclaimer, the term of this patent is extended or adjusted under 35 U.S.C. 154(b) by 0 days.

(21) Appl. No.: 12/540,152

(22) Filed: Aug. 12, 2009

(65) Prior Publication Data

US 2010/0178111 A1 Jul. 15, 2010

Related U.S. Application Data

(60) Provisional application No. 61/143,648, filed on Jan. 9, 2009.

(51) Int. Cl.
*E02B 11/00* (2006.01)

(52) U.S. Cl. ..... 405/45; 405/43; 138/140

(58) Field of Classification Search ..... 405/36, 405/43, 45, 49, 129.7, 302.7; 138/140
See application file for complete search history.

(56) References Cited

U.S. PATENT DOCUMENTS

| | | | | |
|---|---|---|---|---|
| 3,563,038 | A | 2/1971 | Healy et al. | |
| 3,566,607 | A | 3/1971 | Sixt | |
| 3,654,765 | A | 4/1972 | Healy et al. | |
| 3,830,373 | A | 8/1974 | Sixt et al. | |
| 3,976,578 | A | 8/1976 | Beane | |
| 4,180,464 | A | 12/1979 | Beane | |
| 4,182,581 | A | 1/1980 | Uehara et al. | |
| 4,288,321 | A | 9/1981 | Beane | |
| 4,490,072 | A | 12/1984 | Glasser | |
| 4,904,113 | A | 2/1990 | Goddard et al. | |
| 4,909,665 | A | 3/1990 | Caouette | |
| 5,401,552 | A * | 3/1995 | Bohrer et al. | 428/87 |
| 5,795,835 | A * | 8/1998 | Bruner et al. | 442/310 |
| 5,810,509 | A | 9/1998 | Nahlik, Jr. | |
| 5,857,806 | A * | 1/1999 | Melin | 405/115 |
| 5,877,096 | A * | 3/1999 | Stevenson et al. | 442/36 |
| 5,954,451 | A * | 9/1999 | Presby | 405/49 |
| 5,980,745 | A | 11/1999 | Voll et al. | |
| 6,056,479 | A * | 5/2000 | Stevenson et al. | 405/302.7 |
| 6,152,653 | A * | 11/2000 | Henry et al. | 405/129.7 |
| 6,505,996 | B1 * | 1/2003 | Ianniello et al. | 405/36 |
| 6,612,779 | B1 * | 9/2003 | Scuero | 405/116 |
| 7,191,802 | B2 | 3/2007 | Koerner | |
| 7,470,094 | B2 * | 12/2008 | Heathcott et al. | 405/302.7 |
| 2004/0089361 | A1 | 5/2004 | Koerner | |
| 2004/0151548 | A1 * | 8/2004 | Hardin et al. | 405/129.1 |

FOREIGN PATENT DOCUMENTS

WO WO2006077415 A1 7/2006

* cited by examiner

*Primary Examiner* — Tara Mayo-Pinnock

(74) *Attorney, Agent, or Firm* — Law Office of Robert M. Patino

(57) ABSTRACT

A soil drainage system which comprises a core pipe (10) having a plurality of perforations (12). A geocomposite core jacket (14) having a plurality of perforations (16) surrounds the core pipe (10). A geotextile filter fabric (18) wraps around and surrounds the geocomposite core jacket (14). The geotextile filter fabric (18) is permeable to water (20) or other fluids and filters out soil particles (22), or other particles, whereby the water (20) readily permeates the geotextile filter fabric (18), the geocomposite core jacket (14) and the core pipe (10) to provide for a rapid and improved flow of the water (20) and subsequent drainage of the water (20) through the core pipe (10).

23 Claims, 5 Drawing Sheets

SOIL DRAINAGE SYSTEM

CROSS REFERENCE TO RELATED APPLICATIONS

This application claims the priority of Provisional Application 61/143,648 filed on Jan. 9, 2009, which is hereby incorporated by reference in its entirety.

BACKGROUND OF THE INVENTION

1. Field of Invention

The present invention relates primarily to subsurface drainage systems of water or other fluids from soil or other materials, and more specifically to soil drainage systems that provide a new and revolutionary way to extract water or other fluids from soil for a wide variety of applications such as highways, buildings, retaining walls, water wells, slope stabilization, landfills, and farm grounds at low cost and high efficiency.

2. Description of Prior Art

Water drainage from soils is a very critical problem that relates to many important applications that affect our everyday life. Lack of proper drainage of undesirable water from soil exacts a tremendous cost from our economy while extracting usable water from water wells is so essential for living in many areas around the nation and the world. By far the largest application involves our national road and highway systems. Here, in the United States, poor drainage, especially in the winter when freezing and thawing frequently occur, leads to deterioration and failure of pavements, the cost of which is measured in the billions of dollars annually. Lack of soil drainage under homes and buildings causes heavy damage to the foundations and seepage of water and moisture to subsurface building space. This water or moisture damages furniture as well as the structure and creates fungi like mildew, extremely harmful to our health. Lack of drainage behind retaining walls is a major cause of wall failures. Lack of good interior drainage in sloped ground is a major cause of landslides when the ground becomes saturated after heavy precipitation. Drilling and developing water wells for the purpose of extracting water from the ground for domestic use or other uses (purposes) is quite expensive and time consuming. Properly draining farm grounds while controlling the water table and preventing soil loss and erosion is essential for successful farming by adding productive acreage to farms that otherwise will be wasted. Efficient soil drainage can also be a very important tool in cleaning (decontaminating) soils that are contaminated with salts, other chemicals, and certain hazardous wastes.

To improve/establish soil drainage in the above stated applications, a number of approaches are in use in some, while others have yet to be established.

Road and Highway Applications

To improve soil drainage, a number of approaches are in use. These applications include the use of sand, gravel, and other permeable materials as well as a variety of artificial under-surface drains (henceforth referred to simply as drains). The most common drains and their limitations or disadvantages are the following:

(i) The perforated, corrugated, plastic pipe with or without a sock which is a sleeve made from an appropriate filter cloth material. The disadvantages of this system are that the corrugations impede water flow due to induced turbulence, collected precipitates, and provide ideal rodent nesting and infestation environment. (The pipe with a sock clogs up easily) This is especially critical for pavements where the hydraulic gradient (i.e. the slope) is normally quite small and the need to quickly eliminate the water is great. This drain is also difficult to flush clean because the obstructions anchor themselves in the corrugations. Once put in place into dug trenches, the drain requires back filling with granular material to be effective, an added cost. Without granular backfill, drainage is very limited to the small areas radial to the perforations. Also, due to its thin construction, it suffers from low compressive strength and collapse of the pipe from vehicular load is quite common.

(ii) The so-called "French drain", consists of a trench whose walls are lined (or unlined) with a filter fabric and backfilled with sand and/or gravel. It requires a relatively large trench, which means large trench excavation and large amounts of granular backfill material at high cost. This drain suffers from low flow velocity which prevents the removal of water in a timely manner. When lined with a filter fabric, the installation of this drain becomes more labor intensive. The added material and labor increases the cost significantly.

(iii) The geocomposite edge drain, or strip drain, which consists of a cuspate or dimpled plastic skeleton core of a nominal width, usually 24 inches maximum and wrapped all around with geotextile filter fabric. This drain is installed in a narrow trench along the edge of the pavement or behind retaining walls. This drain suffers from low core capacity and the hindrance of longitudinal flow (velocity) by the manner in which the core is constructed.

Homes and Building Applications

Before pouring the concrete for basement floors, trenches are usually dug around and across the basement footprint in such a formation so that the final drainage of water ends up at the sump pump pits. Perforated corrugated pipe drains are then placed in the trenches and are connected in such ways to outlet in the sump pump pits. The trenches are then backfilled with crushed rock or gravel. Most of the time, filter fabric lining of the ditches is omitted to save labor and material. As a result, loss of fine soil and cavitations under the floor slabs can arise with the passage of time and produce loss of support.

Retaining Wall Applications

In retaining wall design and construction, it is essential to reduce or eliminate the water pressure build-up behind the wall. Failure to do so may increase the design pressure load by a factor of 2 or more. In routine retaining wall construction, where construction starts at the bottom, it is relatively easy to design and put into place a good drainage system. The collector perforated pipe is either wrapped in a sock, which is a sleeve made from an appropriate woven filter cloth and backfilled with granular material, or a bare perforated pipe placed inside a finite volume of gravel which is then wrapped or encapsulated with a geotextile filter cloth. In the first case, the flow into the pipe is through the woven filter material immediately across from the pipe perforations; that flow, small to start with, is further reduced significantly by any fine soil that clogs those areas of the filter cloth. In the second case, the safety of the drainage flow is more assured, however at higher material and labor costs. In some of the more complex retaining wall construction, what is called "top down construction", retaining walls like slurry walls, sheet pile walls, and tangent pile walls often have no drainage provisions behind these walls. Yet, these walls, by virtue of the terrain they are in, can benefit greatly from a good drainage system.

Because the ground water is trapped behind the wall, most of the time they are designed for more than twice the design pressure load that a well drained wall is designed for. This means a much higher cost for material and labor and a shortened design life.

Landslide Mitigation

Ground slopes, like the side of a hill, are many times prone to very damaging landslides such as what happens in California, the Northwest United States and elsewhere. This is especially true during periods of heavy precipitation when the ground gets saturated and the build up of pore water pressure in the soil increases the driving forces and reduces the resisting forces, thus resulting in landslides that can destroy buildings and expensive homes that are built on these hills, and can cause blocking of roads and highways that are built on the sides of the hills, even rendering them impassable. This condition can be remedied through the use of so-called "horizontal drains" that are installed at strategic locations deep into the side of the hill or sloping ground. At present, most of these situations go without corrective treatments and spectacular failures take place. The current state of the art technology for horizontal drains employ steel or PVC pipes with evenly spaced slots or perforations and may be fitted with a knitted tubular geotextile sleeve or a simple wrapping of geotextile sheet, though this is not recommended in most situations because the sleeve can inhibit the effectiveness of cleaning and thus promote clogging. The major downfall of these pipes is that they do not effectively drain large amounts of water quickly enough.

Water Wells and Well Points

Water wells are developed and used to extract water from the ground as a valuable resource for domestic consumption and other uses such as for dewatering excavations for structural foundations to facilitate construction below grade. Wells are used in construction when water flow is rather large, while well points, basically small diameter wells, are used in tight soils where the water flow yield is expected to be small. Both water wells and well points employ a metal or plastic intake pipe, a metal screen (the slotted part of the casing or for aquifers that have sand and gravel, either continuous), and a sand filter pack. Slotted screens are made of wire or plastic wrapped around a series of vertical rods, or slotted pipe screens which have very small open areas of machine cut slots into the casing at set distances. As can be implied, the process of installing the well intake screen and filter is difficult, time consuming, expensive, and may not give the most desirable results.

Farm Drains

Proper drainage of farm grounds while controlling loss of soil is essential for successful fanning because it adds productive acreage to farms that otherwise will be wasted because of excessive moisture in the soil or loss of soil. The drain of choice used in this application has been the tile drain or the perforated corrugated pipe. The tile drains come in short lengths of pipe with open joints set next to each other in a ditch and buried in the ground. They are day-lighted at a low point to drain in a drainage ditch or a creek. This drain suffers from limited drainage and major erosion and loss of valuable soil due to piping that occurs through the joints. Corrugated perforated plastic pipe is similarly used, first buried and then set in sand in trenches. This is complicated and expensive to use a good graduated granular filter in the trench around the pipe.

Decontamination of Soil and Farm Irrigation

Good soil drainage can be a very important tool in decontaminating certain soils that are contaminated with residual chemicals, like some of the low lying farm land in San Joaquin Valley in California. This problem has been neglected so far, thus losing to contamination very valuable land. Also controlling optimum water table for different crops in irrigated semi-arid farms in California and elsewhere is greatly enhanced through a good drainage system that controls the depth of the water table.

Landfills

Collecting and removing leachate from landfills is a critical and important environmental concern. A good drainage system employing large, horizontal drains made of plastics with inert properties is a very important tool to accomplish the job of safely collecting and removing leachate to reduce possible groundwater contamination.

SUMMARY OF THE INVENTION

In its preferred embodiment, the invention consists of a rigid, smooth, perforated plastic core PVC pipe, wrapped with one layer of perforated or mesh-like egg-carton or other three-dimensionally-shaped configuration geocomposite core drain material, made of plastic, and one, or more, layers of geotextile filter fabric which is wrapped around the outside of the geocomposite layer. The said filter fabric may be attached by spot bonding or welding to the said geocomposite core. The drainage system may also be manufactured as a single extruded unit. The drain connections for the pipe are standard spigot and socket joints and other accessories and connections would apply. In other embodiments of this invention, the core pipe can be rigid or flexible, perforated or slotted, corrugated or smooth, of any suitable plastic or metal. In other embodiments, the geocomposite core can be any shape that gives adequate compressive strength and promotes drainage, perforated or slotted, of any suitable plastic or material. There may be one or more layers of geotextile filter fabric which may be manufactured as sleeves.

In use of the invention, the flow of fluid into the drainage system is less likely to be diminished by caking of fine particles at the openings. By providing a much larger surface area for fluid to enter into the drainage pipe, more fluid can enter the drainage system and over time, the build up of materials is less likely to significantly clog the drainage system. The entire outer surface of the drainage system is utilized for providing openings for the fluid to drain into the system.

OBJECTS AND ADVANTAGES OF THE INVENTION

Accordingly, besides the objects and advantages of soil drainage system described in my above patent, several objects and advantages of the present invention are:

a) To provide a soil drainage system that can be produced in a variety of sizes, lengths, and types of perforated pipe and perforated geocomposite core jacket strengths using the same process.
b) To provide a soil drainage system that is either rigid or flexible.
c) To provide a soil drainage system that can employ a plastic or a metal pipe.
d) To provide a soil drainage system that may be manufactured in total, or in large part, from new plastic, or recycled plastic resin materials.
e) To provide a soil drainage system that can employ a smooth or corrugated pipe.
f) To provide a soil drainage system that is easily adaptable to most drainage situations.
g) To provide a soil drainage system in which you do not have to keep track of the orientation of the holes in the core pipe.
h) To provide a soil drainage system that can be pre-assembled or manufactured and ready to install.
i) To provide a soil drainage system that is simple to install and inexpensive to manufacture or assemble in place.

j) To provide a soil drainage system that has a large core capacity, as required.

k) To provide a soil drainage system that does not require granular backfill or bedding.

l) To provide a soil drainage system that can be designed to withstand high external pressures or loads.

m) To provide a light-weight drainage system which is easy to handle in construction.

n) To provide a soil drainage system that removes water or other fluids from the soil or other material while filtering out soil particles in an efficient and speedy manner.

o) To provide a high capacity drainage system at low cost and low installation time.

p) To provide a soil drainage system with excellent longitudinal flow properties.

Still further objects and advantages will become apparent from a consideration of the ensuing description and drawings.

PART NUMBERS USED IN THE DRAWINGS

Figure 1:
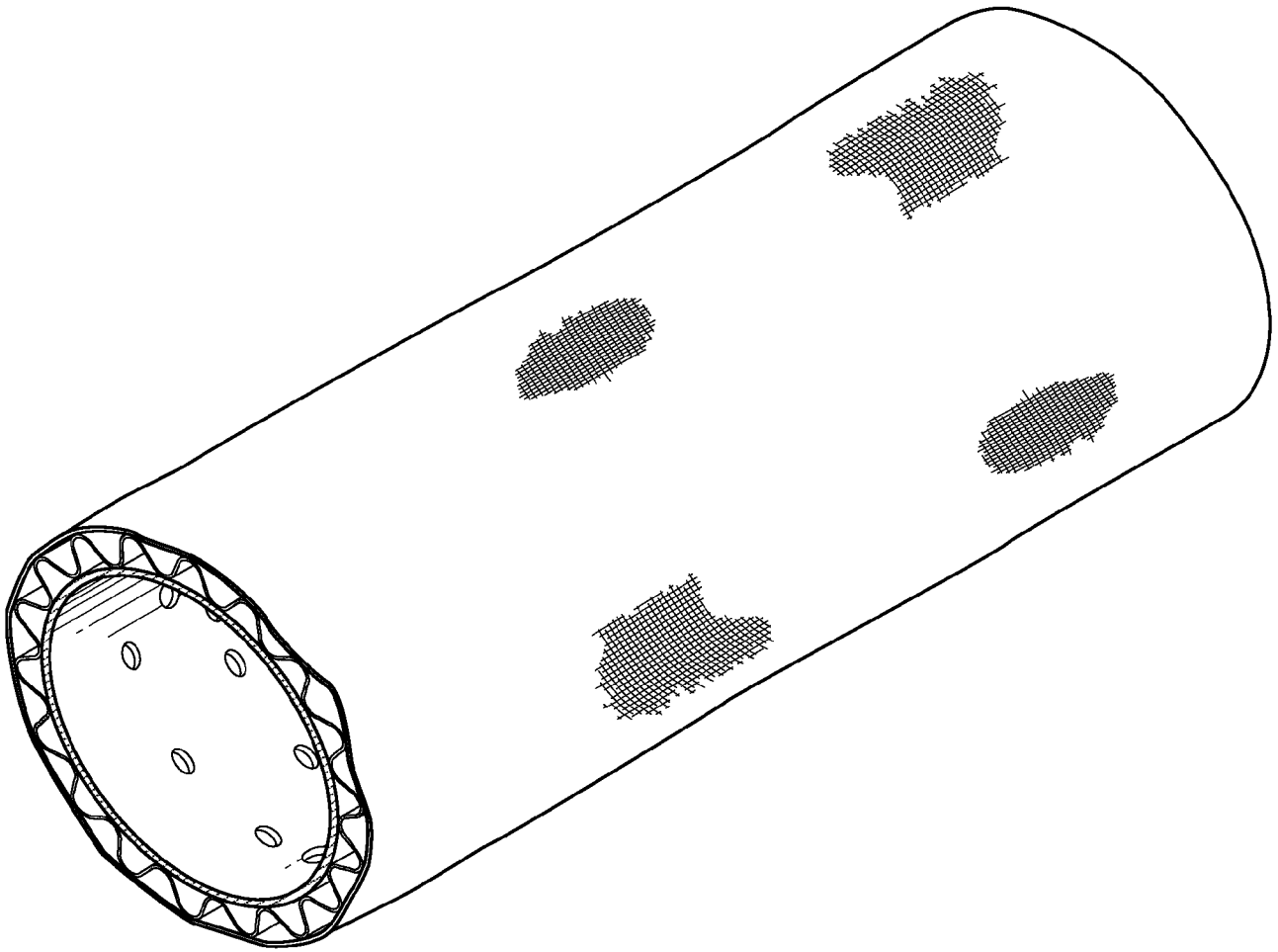
FIG. 1 is an isometric view of an embodiment of the present invention.
Figure 2:
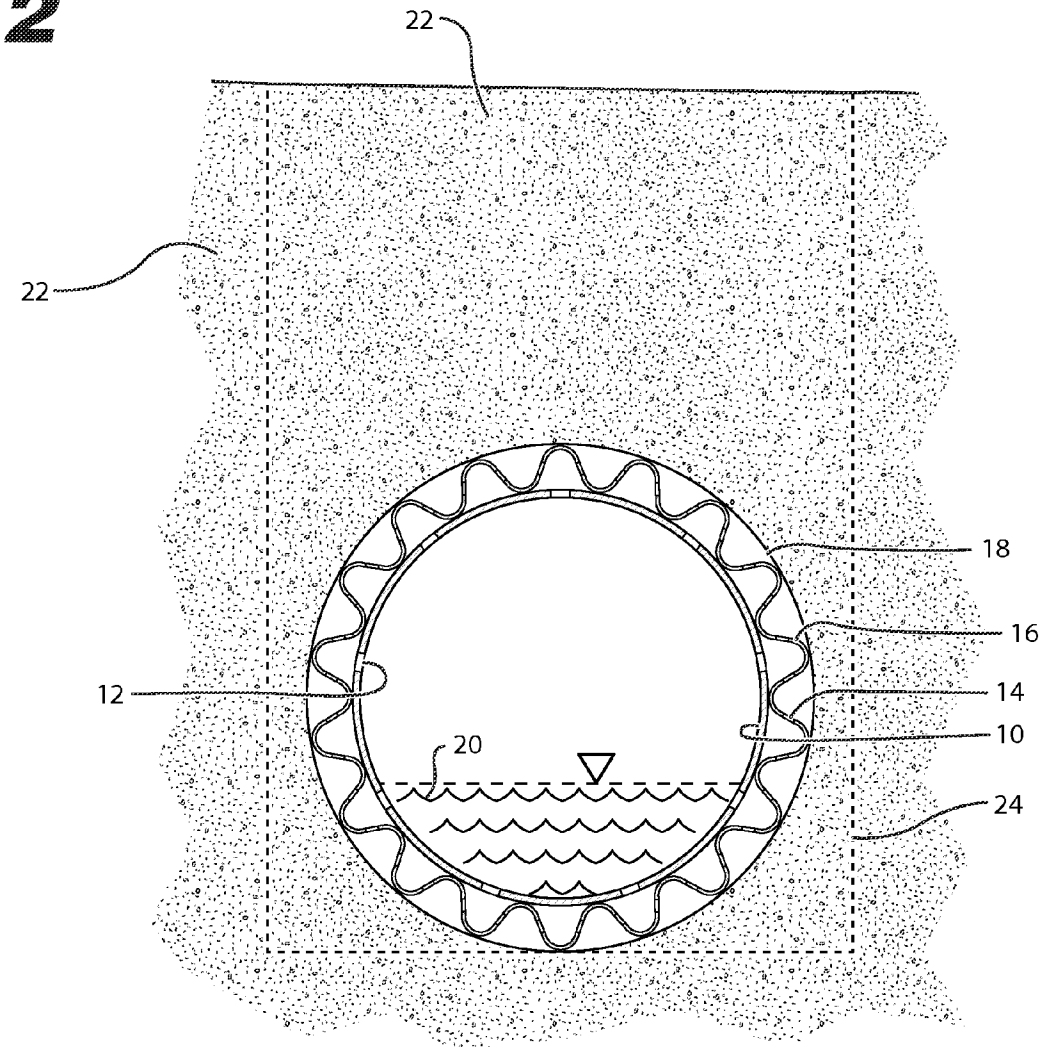
FIG. 2 is a cross-sectional view showing an embodiment of the present invention installed in the soil.

10 core pipe of soil drainage system
12 perforations in core pipe
14 geocomposite core jacket of soil drainage system
16 perforation in geocomposite core jacket
18 geotextile filter fabric
20 water or other fluid
22 soil or other material to be drained
24 trench excavation line

DETAILED DESCRIPTION OF THE PREFERRED EMBODIMENTS

Referring now to the figures, in which like numerals indicate like parts, and particularly to FIGS. 2 through 5, will be discussed with reference thereto. FIG. 1 is an isometric view of an embodiment of the invention. The present invention is a soil drainage system which comprises a core pipe 10 having a plurality of perforations 12. A geocomposite core jacket 14 having a plurality of perforations 16, wherein the geocomposite core jacket 14 surrounds the core pipe 10. A geotextile filter fabric 18 wraps around and surrounds the geocomposite core jacket 14. The geotextile filter fabric 18 is permeable to water 20 and filters out even small particles of soil 22, whereby the water 20 readily permeates the geotextile filter fabric 18, the geocomposite core jacket 14 and the core pipe 10 to provide for a rapid and improved flow of the water 20 and subsequent drainage of the water 20 through the core pipe 10. More than one layer of geotextile filter fabric 18 may be needed, depending on the application and surrounding soil. The geotextile filter fabric 18 may also overlap with adjacent pieces and other layers.

Soil 22 may encompass many items that may be drained. This may include dirt, clay, waste-derived materials such as landfills, sand, or other material holding fluids. The geotextile filter fabric 18 filters small particles such that those particles that are not desirable to be removed are not allowed into the drainage system. The fluids may commonly be water but can be other liquids, such as leachate, oil, or others.

In a preferred embodiment of the invention, a rigid, smooth, perforated core plastic PVC core pipe 10, wrapped with one layer of perforated or mesh-like egg-carton or similar-shaped configuration geocomposite core jacket 14 drain material, made of plastic, and one, or more, layers of needle-punched geotextile filter fabric 18 which is wrapped around the outside of the geocomposite core jacket 14 layer.

It is preferred to use a geotextile filter fabric 18 manufactured with needle-punched process, but woven and non-woven filter fabrics and other construction methods which allow the transmission of water 20 through the geotextile filter fabric 18 but prevent the passage of soil, sand, and other fine particles through the geotextile filter fabric 18 may be used. The Geosynthetic Research Institute has produced a method of selecting an appropriate filter fabric for many uses, applications, and surrounding soil types.

The perforations 12 of the core pipe 10 are preferably located all around the circumference and the length of the core pipe 10, rather than being just limited to the underside of the core pipe 10. The perforations 12 of the core pipe 10 are preferably either holes or slots, but may be of other shapes to allow flow of water 20.

The perforations of the geocomposite core jacket 14 are located all around the circumference of the geocomposite core jacket 14. The perforations 16 of the geocomposite core jacket 14 may be holes or slots, or other openings to allow for the flow of water 20. The geocomposite core jacket 14 is preferably an egg-carton shaped tube, that is cuspated or dimpled, but a variety of shapes may be used. The geotextile filter fabric 18 may be spot attached to the geocomposite core jacket 14 by bonding or welding thereto.

In other embodiments of this invention, the core pipe 10 can be rigid or flexible, corrugated or smooth, and fabricated from any suitable plastic or metal material. The geocomposite core 14 can be any shape that gives adequate compressive strength and promotes drainage, perforated or slotted, of any suitable plastic material. There may also be one or more layers of the geotextile filter fabric 18 which may be manufactured as sleeves.

Figure 4:
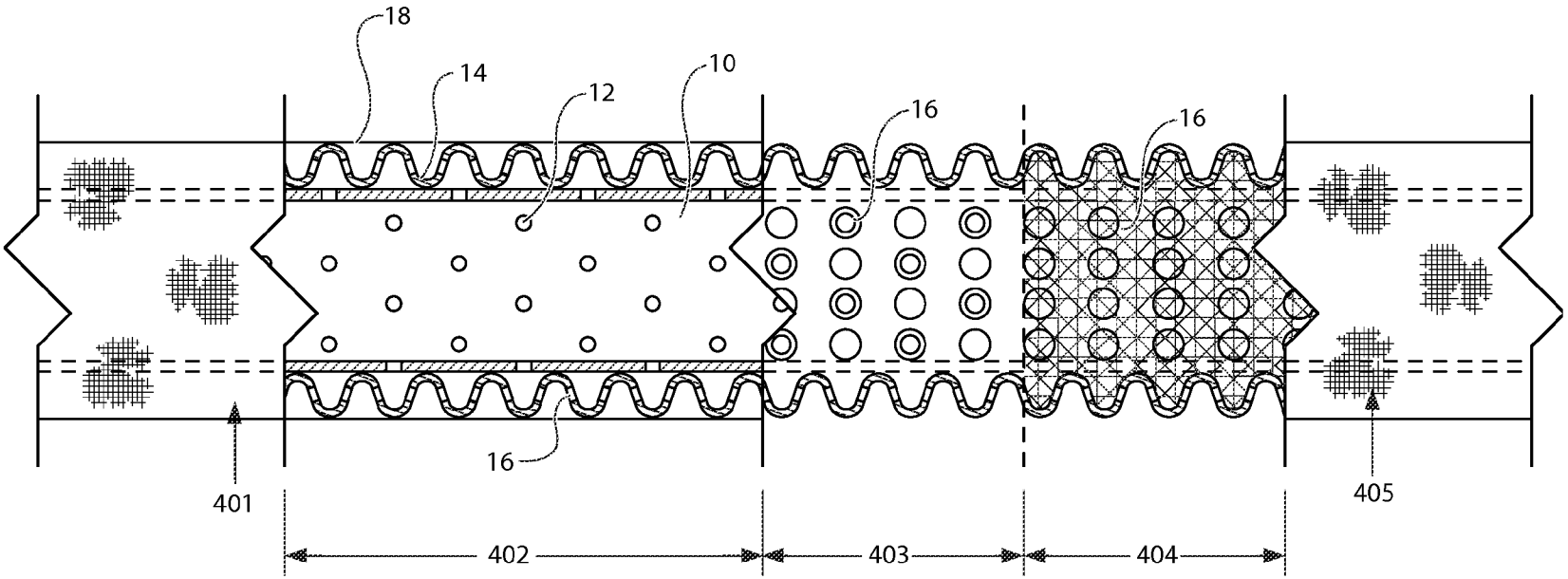
FIG. 4 is a series of views showing different layers of construction of the invention.

As shown in FIG. 4, the construction of the preferred embodiment is broken down through the layers of the drainage system. In section 401, the geotextile filter fabric 18 is shown as wrapped around the core pipe 10 and the geocomposite core jacket 14. Section 402 then shows the system with the partial, exploded longitudinal cross-section. Section 403 shows the geotextile filter fabric 18 removed, thus exposing the perforated, generally egg-carton-shaped, geocomposite core jacket 14 which surrounds the core pipe 10. Section 404, similar to section 403, shows a mesh-like egg-carton shaped geocomposite core jacket 14, as a preferred embodiment. Section 405 is another illustration, similar to Section 401 showing the outer layer of geotextile filter fabric 18.

Figure 5:
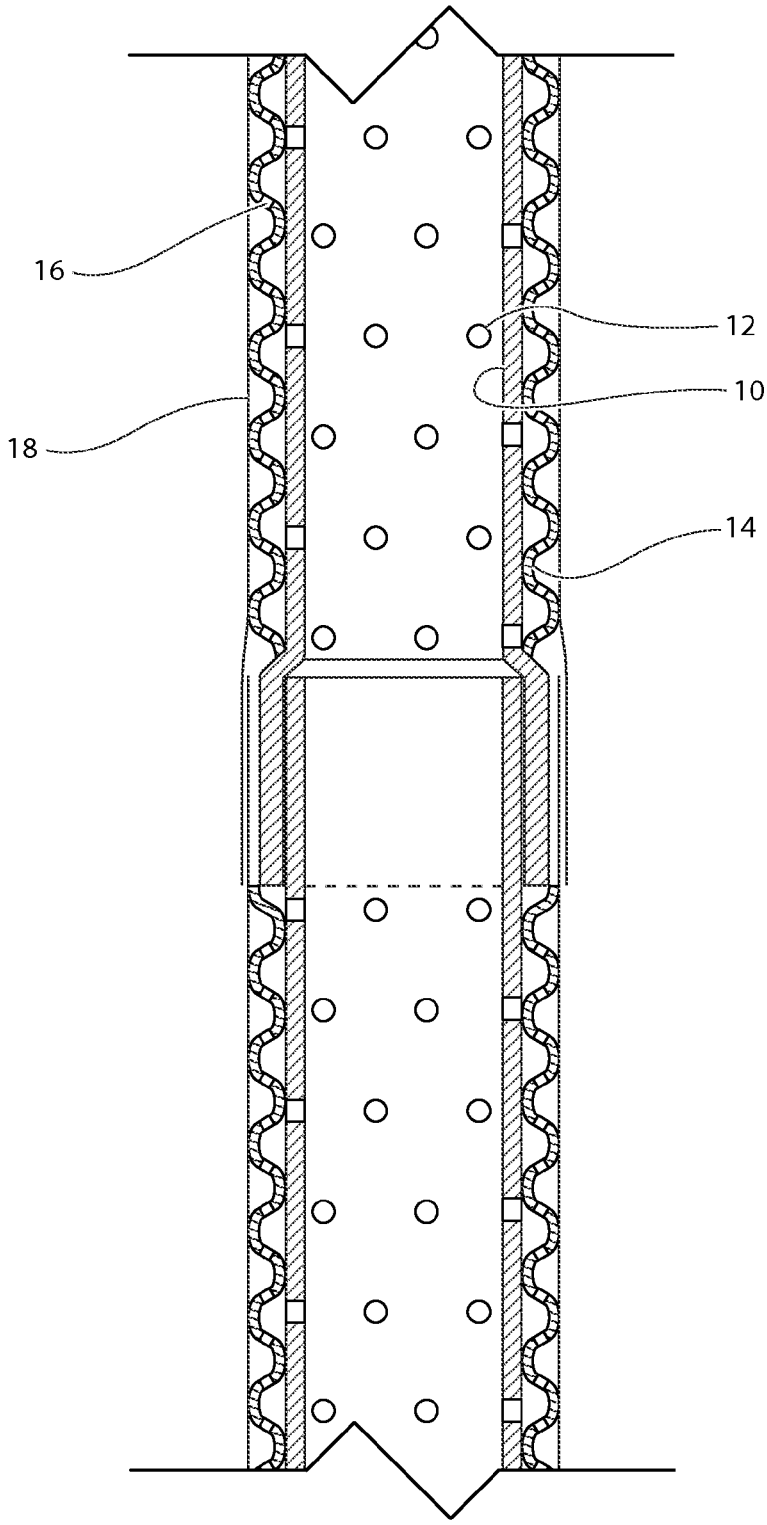
FIG. 5 is a longitudinal cross-sectional view showing the spigot and socket joint connections between the invention drainage system units.

Connection of the units of the drainage system is similar to other drainage pipe construction methods. The most common method of pipe fitting is the spigot and socket connection between the pipe units, as shown in FIG. 5. The core pipe 10 perforations 12 would preferably not extend into the joint sections, while the geotextile filter fabric 18 over the spigot end of one core pipe 10 unit would overlap with that over the socket end of the adjacent core pipe 10 unit to help prevent the passage of soil 22 or fine materials into the drainage system.

Operation

The geotextile filter fabric 18 is to protect the geocomposite core jacket 14 and core pipe 10 from infiltration of fine particles that can result in sediment in the core pipe 10 and loss of the soil 22 and flow capacity. Most importantly, it provides a 100% surface of transmissibility of the water 20 through the perforated geocomposite core jacket 14 and into the perforated core pipe 10.

In installation for a horizontal pipe drainage system, a trench 24 is dug for the location of the drainage system. Then the drainage system is installed into the bottom of the trench 24. Some bedding material, such as sand, may be utilized under the drainage system to provide additional support for the drainage system. After connection to the adjacent drainage system units, backfill 22 of the native materials, often soil, may be placed under, around, and over the drainage system, without additional labor or materials for placing filtering materials, as was previously needed in some prior construction methods. Also, the volume of excess soil to be disposed of is much reduced, thus lowering the cost.

While the most common fluid for drainage is water 20, there is a need for landfill drains to drain the leachate from the landfill or storage area having waste-derived materials. Construction of drains for leachate using the present invention would be superior to existing methods used and should ensure a longer life of the drains without becoming clogged. These landfill drains can be utilized in horizontal and vertical orientations for collecting and extracting leachate respectively. The system could also be utilized for removing methane or other gases.

Figure 3:
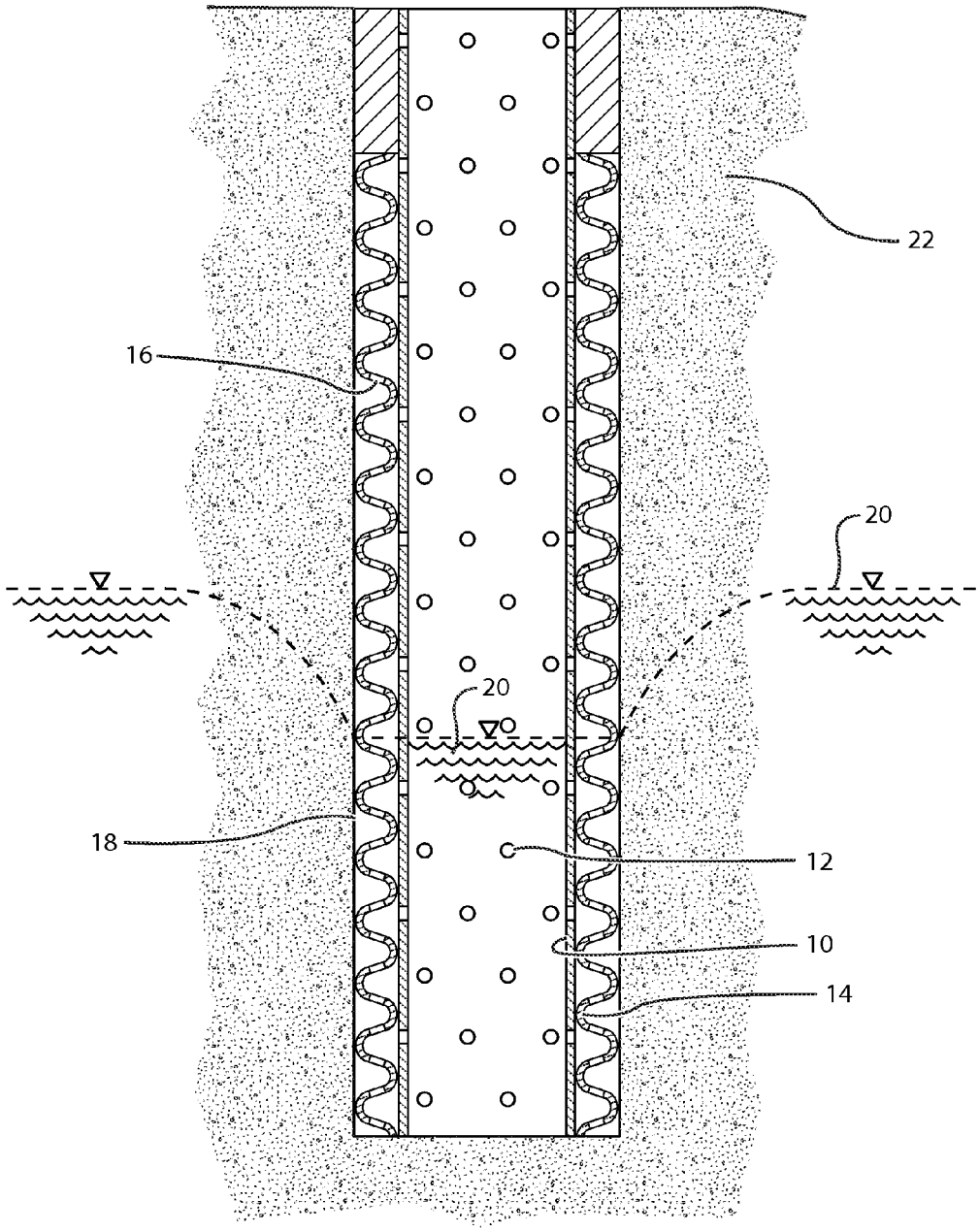
FIG. 3 is a longitudinal cross-sectional view showing an embodiment of the invention in a vertical orientation.

In construction of a vertical orientation of the invention, as shown in FIG. 3, a well, monitoring well, or similar construction could quickly be built. A suitable size diameter hole could be augured through the soil or material to be drained. The drainage system of the invention could be installed to allow the fluid to enter into the core pipe 10 of the drainage system for draining, pumping, testing, or the like, without burdensome well screens or other filtering.

Possible Applications

The most extensive application of the present invention is expected to be lateral and edge drains for highway pavements. However, its use can be applied in many other applications. Examples include but are not limited to:

a) Airport runways and taxiways
b) Farm drains and in ventilation of crop bins
c) Water well screen as vertical drains
d) Well point screen as vertical drains
e) De-watering wells screen as vertical drains
f) Landfill wells and drains to extract leachate and landfill horizontal drains to collect leachate
g) Home foundations
h) Building foundations
i) Stabilize slopes—so called "horizontal drains" (landslide mitigation)
j) Behind Retaining walls as horizontal drains
k) Behind Sheet pile walls as vertical drains
l) Behind Tangent pile walls as vertical drains
m) Behind slurry walls as vertical drains
n) Decontaminating soils.
o) Residential drain for downspouts Advantages The present invention overcomes the previously mentioned disadvantages by combining the advantages of the core pipe 10 and the geocomposite core jacket 14 and geotextile filter fabric 18 to produce a novel concept with great advantages over the present state-of-the-art concepts. The geotextile filter fabric 18 provides a full surface of infiltration into the unobstructed perforated, generally egg-carton-shaped, or other shaped, geocomposite core jacket 14, which in turn provides quick discharge of the infiltrated water 20 into the core pipe 10, thus providing very efficient, high capacity flow in the core pipe 10. This solves the core flow capacity problems associated with the strip geocomposite core drains of the prior art. The perforated, generally egg-carton-shaped or other shaped geocomposite core jacket 14 replaces the need for granular material backfill around the pipe, thus saving natural resources and much lower labor costs. It allows infiltration from the full outer surfaces covered with filter fabric material as compared to infiltration which is localized only at the pipe perforations for a pipe with a knitted tubular geotextile sock only.

In prototype testing, a suitable plastic mesh-like generally egg-carton-shaped, material for the geocomposite core jacket 14 was tested using the TIGER DRAIN material formerly produced by Exxon Mobil Corporation. When placed around the core pipe 10, it produced a resulting drainage system with the desired characteristics.

A good drainage system should be designed such that the area of interface between the drainage media is as large as practicable. The flow transmissibility area through the geotextile filter fabric 18 and the perforated geocomposite core jacket 14 of this invention, compared to that of the pipe with only a knitted tubular geotextile sock, would result in an increase of about 500 times, a phenomenal 50,000% increase (see calculations section). The core pipe 10 provides a large capacity, as needed by design that accelerates the drainage process without the need for closely spaced outlets. The use of the preferred smooth perforated core pipe 10 produces higher velocity laminar flow which reduces the possibility of the water 20 freezing and the sedimentation of precipitants to occur as compared to corrugated pipes and geocomposite edge drains where the flow is very slow. Furthermore, any rodent infestation or other blockages can be easily flushed out. The soil drainage system of the present invention has a very long useful life as compared to the sock covered pipe because the later can be easily clogged and rendered unbeneficial due to the small area of infiltration (transmissibility).

The whole system, or parts of it can be manufactured from new plastic resins or recycled plastic resins, thus saving natural resources and cost.

Calculations

Calculations may be made to determine the area of inflow into the pipe and compare an embodiment of the invention with a standard drainage pipe.

Assuming a five inch diameter smooth core pipe, for each lineal foot of pipe length, having ¼ inch diameter holes, and eight holes per foot of pipe, as is common.

The area of each hole is:

$$\text{Area} = \frac{D^2}{4} = \frac{(0.25^2)}{4} = \overline{64} = 0.049\ \text{in}^2$$

Total area of all holes allowing the water to permeate into the traditional pipe per lineal foot of pipe for the common pipe:

$$\text{Area} = 0.0491 \times 8 = 0.3927\ \text{in}^2 \text{ for each lineal foot of pipe}$$

Surface area of the embodiment of the present invention with the core pipe 12 wrapped with the geocomposite jacket 16 and the geotextile filter fabric 20:

$$\text{Area}=\pi D(\text{length of pipe})=(\pi)(5\text{ inches})(12\text{ inches})=188.5\text{ in}^2\text{ for each lineal foot of pipe}$$

The ratio of increase in transmissibility of permeable surface areas to compare the embodiment of the present invention shown with the traditional pipe:

$$=\frac{187\text{ in}^2\text{ per foot}}{0.39\text{ in}^2\text{ per foot}}=497\text{ times}\sim 500\text{ times}\sim 500\text{ times}\times 100=50{,}000\%$$

The percentage increase is around 48,000% larger inflow surface area.

Also there is an increase in core flow velocity as compared with a corrugated pipe or a geocomposite edge drain.

Experimentation

In trials, two models of the soil drainage system were built, one with smooth PVC pipe and one with corrugated plastic pipe, with fine sand backfill. The sand then was saturated with water to the top about two feet above the drainage system before allowed to drain. The two tests showed remarkable draining capacity in the speed the water 20 was drained out, though no time of drainage was recorded.

It will be understood that each of the elements described above, or two or more together, may also find a useful application in other types of constructions differing from the types described above.

CONCLUSION, RAMIFICATIONS AND SCOPE

A combination perforated core pipe, perforated geocomposite drain core, and geotextile filter fabric system is provided for draining water or other fluids from soil under highway pavement, behind retaining walls, under home and building foundations, from saturated slopes prone to landslide failures, farms, decontaminated soils, and water well intakes among others. A high efficiency drainage system having a perforated core pipe as the main core which is wrapped (surrounded) with a perforated geocomposite generally egg-carton-shaped or other shaped configuration plastic core to replace granular backfill, which in turn is wrapped around with geotextile filter fabric which may be spot bonded or welded to the geocomposite core. The filter fabric prevents the migration of soil or other particles into the drainage system while allowing water or other fluids to pass through its large surface area.

While the invention has been illustrated and described as embodiments of a soil drainage system, accordingly it is not limited to the details shown, because it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

I claim:

1. A soil drainage system for removing fluid from adjacent material into an internal core pipe which comprises:

a core pipe having a plurality of perforations;

a geocomposite core jacket having a generally egg-carton shape with raised peaks and lowered valleys, wherein said geocomposite core jacket wraps around said core pipe in a circular manner and is provided with a plurality of perforations to allow passage of fluid into said core pipe; and a geotextile filter fabric which wraps around and surrounds said geocomposite core jacket, wherein said geotextile filter fabric is permeable to fluid and filters out soil particles, whereby the fluid permeates said geotextile filter fabric, said geocomposite core jacket and said core pipe to provide for flow of the fluid and subsequent drainage of the fluid through said core pipe.

2. The system as recited in claim 1, wherein said perforations of said core pipe are located all around the circumference and along the length of said core pipe.

3. The system as recited in claim 1, wherein said geocomposite core jacket is a tube.

4. The system as recited in claim 1, wherein said perforations of said geocomposite core jacket are located all around the surface of said geocomposite core jacket.

5. The system as recited in claim 1, wherein said perforations of said geocomposite core jacket are holes.

6. The system as recited in claim 1, wherein said perforations of said geocomposite core jacket are slots.

7. The system as recited in claim 1, wherein said perforations of said geocomposite core jacket are formed by a generally mesh-like construction.

8. The system as recited in claim 1, wherein said geocomposite core jacket is cuspated.

9. The system as recited in claim 1, wherein said geotextile filter fabric is comprised of one or more layers of geotextile filter fabric.

10. The system as recited in claim 1, wherein said geotextile filter fabric is spot attached to said geocomposite core jacket.

11. The system as recited in claim 1, wherein said geotextile filter fabric is spot attached to said geocomposite core jacket by bonding thereto.

12. The system as recited in claim 1, wherein said geotextile filter fabric is spot attached to said geocomposite core jacket by welding thereto.

13. The system as recited in claim 1, wherein said perforations of said core pipe are holes.

14. The system as recited in claim 1, wherein said perforations of said core pipe are slots.

15. The system as recited in claim 1, wherein said geocomposite core jacket is dimpled.

16. A method of removing fluid from adjacent material into an internal core pipe comprising:

installing a pipe having a plurality of perforations into the material, wherein the pipe includes a geocomposite core jacket surrounding the pipe in a circular manner, said geocomposite core comprises a generally egg-carton shape with raised peaks and lowered valleys and a plurality of perforations to allow passage of fluid into said pipe; and a geotextile filter fabric which wraps around and surrounds said geocomposite core jacket, wherein said geotextile filter fabric is permeable to fluid and filters out soil particles and other materials, whereby the fluid permeates said geotextile filter fabric, said geocomposite core jacket and said pipe; and providing a flow of the fluid through the pipe to an outlet, outside the material.

17. The method of draining fluid from a material according to claim 16, wherein the fluid is leachate.

18. The method of draining fluid from a material according to claim 16, wherein the material is soil.

19. The method of draining fluid from a material according to claim 16, wherein the material is waste-derived material.

20. The method of draining fluid from a material according to claim 16, wherein the fluid is water.

21. The method of draining fluid from a material according to claim 16, wherein the flow is by gravity.

22. The method of draining fluid from a material according to claim 16, wherein the flow is by pumping.

23. A soil drainage system for removing fluid from adjacent material into an internal core pipe which comprises:

a core pipe having a plurality of perforations and comprised of a variety of materials;

a geocomposite core jacket having a generally egg-carton shape with raised peaks and lowered valleys and a plurality of perforations, wherein said geocomposite core jacket surrounds said core pipe in a circular manner and is comprised of a variety of materials; and a geotextile filter fabric which wraps around and surrounds said geocomposite core jacket, wherein said geotextile filter fabric is permeable to the fluid and filters out soil particles and other materials, whereby the fluid permeates said geotextile filter fabric, said geocomposite core jacket provides a means of transporting fluid into said core pipe and said core pipe provides for a flow of the fluid and subsequent drainage of the fluid through said core pipe.

* * * * *